US009455521B2

(12) United States Patent
Bang et al.

(10) Patent No.: US 9,455,521 B2
(45) Date of Patent: Sep. 27, 2016

(54) LEVER TYPE CONNECTOR

(71) Applicants: Hyundai Motor Company, Seoul (KR); Kia Motors Corporation, Seoul (KR); Kum Co., LTD, Ulsan (KR)

(72) Inventors: Min Jae Bang, Gyeonggi-do (KR); Sung Won Jeon, Ulsan (KR); Sang Ho Bae, Ulsan (KR); Doo Hee Baek, Ulsan (KR)

(73) Assignees: Hyundai Motor Company, Seoul (KR); Kia Motors Corporation, Seoul (KR); Kum Co., LTD, Ulsan (KR)

( * ) Notice: Subject to any disclaimer, the term of this patent is extended or adjusted under 35 U.S.C. 154(b) by 0 days.

(21) Appl. No.: 14/862,713

(22) Filed: Sep. 23, 2015

(65) Prior Publication Data

US 2016/0164215 A1 Jun. 9, 2016

(30) Foreign Application Priority Data

Dec. 3, 2014 (KR) ..... 10-2014-0172308

(51) Int. Cl.
*H01R 13/502* (2006.01)
*H01R 13/453* (2006.01)
*H01R 13/629* (2006.01)

(52) U.S. Cl.
CPC ..... *H01R 13/502* (2013.01); *H01R 13/4538* (2013.01); *H01R 13/62938* (2013.01)

(58) Field of Classification Search
CPC ..... H01R 23/02; H01R 13/62933; H01R 13/62938
USPC ..... 439/660, 140, 157, 372
See application file for complete search history.

(56) References Cited

U.S. PATENT DOCUMENTS 5,501,606 A * 3/1996 Oda ..... H01R 13/631 439/140
6,095,833 A * 8/2000 Osawa ..... H01R 13/62933 439/157
6,146,161 A * 11/2000 Osawa ..... H01R 13/62955 439/140
6,193,531 B1 * 2/2001 Ito ..... H01R 13/62933 439/140
6,544,054 B2 * 4/2003 Ishikawa ..... H01R 13/62933 439/157
6,692,274 B2 * 2/2004 Maegawa ..... H01R 13/62933 439/157
6,761,568 B2 * 7/2004 Bakker ..... H01R 13/4538 439/140
6,846,191 B2 * 1/2005 Hobbs ..... H01R 13/4538 439/140
7,063,548 B2 * 6/2006 Ohara ..... H01R 13/641 439/157
7,134,901 B2 * 11/2006 Okura ..... H01R 13/4538 439/140

(Continued)

FOREIGN PATENT DOCUMENTS

JP 2009-163953 A 7/2009
KR 2013-0121644 A 11/2013

(Continued)

*Primary Examiner* — Neil Abrams
*Assistant Examiner* — Travis Chambers
(74) *Attorney, Agent, or Firm* — Mintz Levin Cohn Ferris Glovsky and Popeo, P.C.; Peter F. Corless

(57) ABSTRACT

A lever type connector includes: a male housing having a box shape in which one side is open and a bottom surface for receiving a male terminal; a plate inserted into the male housing for covering the male terminal; a female housing for insertion into the male housing; and a lever rotatably coupled with the female housing, when the plate support member supports the plate so that the plate which protrudes from an inner side wall of the male housing to be inserted into the male housing is not inserted up to the bottom surface of the male housing.

12 Claims, 15 Drawing Sheets

(56) References Cited

U.S. PATENT DOCUMENTS 7,201,609 B2 * 4/2007 Ishikawa ..... H01R 13/5219 439/157
7,210,948 B2 * 5/2007 Nishide ..... H01R 13/62938 439/157
7,249,958 B2 * 7/2007 Ishikawa ..... H01R 13/631 439/140
7,261,575 B2 * 8/2007 Buchter ..... H01R 13/62944 439/157
7,329,133 B2 * 2/2008 Ishikawa ..... H01R 13/62938 439/140
7,448,888 B2 * 11/2008 Okano ..... H01R 13/4538 439/157
7,458,832 B2 * 12/2008 Shibata ..... H01R 13/64 439/157
7,559,779 B1 * 7/2009 Caines ..... H01R 13/62938 439/157
7,581,969 B2 * 9/2009 Matsushita ..... H01R 13/514 439/140
7,588,446 B2 * 9/2009 Kobayashi ..... H01R 13/62933 439/135
8,038,455 B1 * 10/2011 Moraes ..... H01R 13/4538 439/140
8,075,351 B2 * 12/2011 Park ..... H01R 13/40 439/372
8,142,213 B2 * 3/2012 Zheng ..... H01R 13/5221 439/157
8,147,261 B2 * 4/2012 Horiuchi ..... H01R 13/514 439/157
2002/0064984 A1 * 5/2002 Ishikawa ..... H01R 13/62933 439/157
2003/0119349 A1 * 6/2003 Bakker ..... H01R 13/4538 439/140
2006/0084304 A1 * 4/2006 Ohara ..... H01R 13/641 439/157
2006/0110960 A1 * 5/2006 Yamaoka ..... H01R 13/62944 439/157
2008/0090435 A1 * 4/2008 Ikeya ..... H01R 13/62938 439/157
2008/0102667 A1 * 5/2008 Ikeya ..... H01R 13/62938 439/157
2008/0119074 A1 * 5/2008 Okano ..... H01R 13/62938 439/140
2010/0271043 A1 10/2010 Katoh

FOREIGN PATENT DOCUMENTS

KR 10-1342165 B1 12/2013
KR 10-1396303 B1 5/2014

* cited by examiner

<Related Art>

<Related Art>

LEVER TYPE CONNECTOR

CROSS-REFERENCE TO RELATED APPLICATION

This application claims under 35 U.S.C. §119(a) the benefit of Korean Patent Application No. 10-2014-0172308, filed on Dec. 3, 2014 in the Korean Intellectual Property Office, the entire contents of which are incorporated herein by reference.

BACKGROUND (a) Technical Field

The present invention relates to a lever type connector, and more particularly, to a lever type connector provided with a plate capable of protecting a male terminal of a male housing and allowing a female housing to return to an original position as soon as the female housing is separated from the male housing.

(b) Description of the Related Art

Generally, a connector is used to connect wirings of a brake, a headlight, and the like of a vehicle.

FIGS. 1 and 2 (RELATED ART) are diagrams illustrating a male housing 110 of the connector. As shown in FIGS. 1 and 2, the existing connector includes the male housing 110 having an open one side and a male terminal 150 protruding from a bottom surface of the male housing 110. A female housing (not shown) is inserted through the open portion of the male housing 110 to electrically connect the male terminal 150 on the bottom surface of the male housing 110 to the female housing (not shown).

In connection with the connector used in vehicles, the number of connector circuits for circuit processing generally has increased due to an increase in electric components according to an increase in convenience devices such as multimedia, GPS, and information communication equipment, along with an increase in the number of wirings for various data and signals for driving vehicles and operating devices.

An increase in the number of circuits requires a multi-pole circuit connector, and as a result, a cross sectional area of the open portion for receiving the female housing (not shown) of the male housing 110 is increased. Therefore, the male terminal 150 on the bottom surface of the male housing 110 is more likely to be exposed to external environments, which leads to problems of damage, deformation, and warpage of the terminal 150, a mixing of foreign materials, and the like.

SUMMARY

An aspect of the present invention provides a lever type connector provided with a plate capable of protecting a male terminal of a male housing.

According to an exemplary embodiment of the present invention, a lever type connector, includes: a male housing configured to have a box shape in which one side is open and has a bottom surface from which a plurality of male terminals protrude; a plate configured to be inserted into the male housing and cover the male terminal; a female housing configured to be inserted into the male housing; and a lever configured to be rotatably coupled with the female housing, wherein a plate support member supports the plate so that the plate support member which protrudes from an inner side wall of the male housing to be inserted into the male housing is not inserted up to the bottom surface of the male housing, the plate is provided with a support part which is locked and supported by the plate support member, and the plate support member of the male housing is unlocked from the support part of the plate when the female housing is inserted into the male housing and the plate moves to the bottom surface of the male housing along with the female housing.

The plate support member may be made of an elastic material.

The lever type connector may further include: a releasing protrusion configured to protrude from an outer side of the female housing and press the plate support member when the female housing is inserted into the male housing to release the locking of the plate support member and the support part.

The plate support member may be spaced apart from the inner side wall of the male housing at a predetermined distance and the plate support member may be deformed toward the inner side wall of the male housing when the female housing is inserted into the male housing and is unlocked from the support part of the plate.

The lever type connector may further include: a plate separation preventing protrusion configured to protrude from an upper portion of the plate support member of the male housing, being spaced apart from the plate support member at a predetermined distance and support the plate so that the plate inserted into the male housing is not separated from the inside of male housing, wherein the plate may be provided with a separation preventing part which is supported by the plate separation preventing protrusion and the plate may move along with the female housing when the female housing is separated from an inner side of the male housing and the separation preventing part of the plate may be supported by the plate separation preventing protrusion of the male housing to prevent the plate from being completely separated.

The lever type connector may further include: a returning protrusion configured to protrude between the support part of the plate and the separation preventing part, and plate tow protrusions configured to protrude from an outer side of the female housing and be locked to the returning protrusion when the female housing is separated from the inner side of the male housing to move the plate along with the female housing.

The plate tow protrusions may be formed at both sides of the releasing protrusion, having the releasing protrusion disposed therebetween.

The returning protrusion may be made of an elastic material.

A lever type connector can include: a male housing having a box shape in which one side is open and a bottom surface for receiving at least a male terminal; a plate configured to be inserted into the male housing for covering the male terminal; a female housing configured to be inserted into the male housing; a lever configured to be rotatably coupled with the female housing; and a plate support member that supports the plate, wherein the plate support member is not inserted up to the bottom surface of the male housing, the plate is provided with a support part which is locked and supported by the plate support member, and the plate support member of the male housing is unlocked from the support part of the plate when the female housing is inserted into the male housing.

BRIEF DESCRIPTION OF THE DRAWINGS

The above and other objects, features and advantages of the present invention will be more apparent from the following detailed description taken in conjunction with the accompanying drawings.

DETAILED DESCRIPTION

Figure 1:
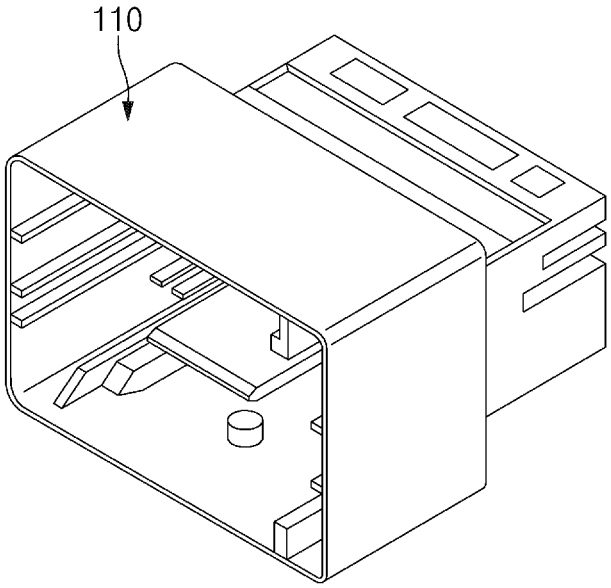
FIGS. 1 and 2 (RELATED ART) are diagrams illustrating a male housing according to the related art.
Figure 2:
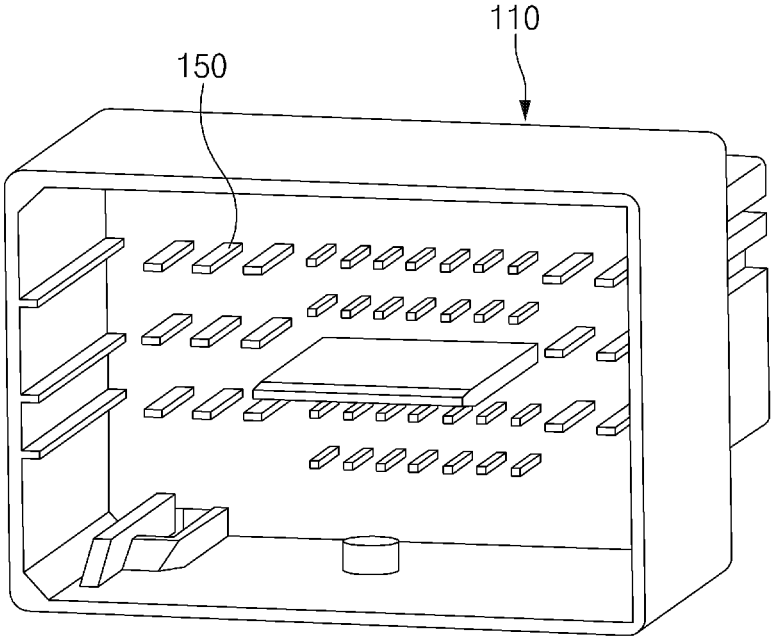

It is understood that the tem "vehicle" or "vehicular" or other similar tem as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the tem "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, exemplary embodiments of the present invention will be described in detail with reference to the accompanying drawings. As shown in FIGS. 3 to 15, a lever type connector according to an exemplary embodiment of the present invention includes a male housing 10, a plate 30 provided to be inserted into the male housing 10, and a female housing 20 inserted into the male housing 10.

Figure 3:
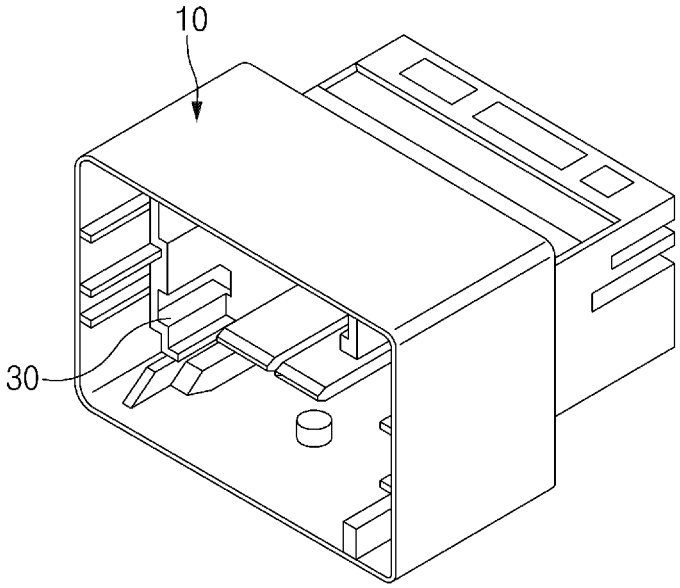
FIG. 3 is a perspective view of a male housing of a lever type connector according to an exemplary embodiment of the present invention that is coupled with a plate.

As shown in FIG. 3, the male housing 10 is provided in a box shape in which one side is open. A plurality of male terminals (not shown) protrude from a bottom surface of the male housing 10 and are coupled with the female housing 20 which is inserted into the male housing 10. A plate support member 15 protrudes on an inner side wall of the male housing 10 (see FIG. 7). The plate support member 15 is formed to be spaced apart from the inner side wall of the male housing 10 at a predetermined distance and is made of an elastic material. Therefore, the plate support member 15 is easily deformed toward the inner side wall of the male housing 10. The plate support member 15 supports the plate inserted into the male housing 10 so that the plate is not inserted up to the bottom surface of the male housing 10. In particular, an upper support surface 13 of the plate support member 15 keeps a locked state with a support part 31 of the plate, to be described below, to prevent the plate from being inserted further inwardly. Meanwhile, the plate support member 15 of an elastic material is pressed by an outer side of the female housing 20 at the time of insertion of the female housing 20 and thus is deformed toward the inner side wall, and thus the plate support member 15 is unlocked from the support part 31 of the plate to move the plate to the bottom surface of the male housing 10 along with the female housing 20.

Meanwhile, a plate separation preventing protrusion 11 protrudes from an upper portion of the plate support member 15 of the male housing 10, and is spaced apart from the plate support member 15. The plate separation preventing member 11 supports the plate so that the plate inserted into the male housing 10 is not separated from the inside of the male housing 10. In particular, the plate support member 15 stops the plate from moving toward the bottom surface of the male housing 10, and the plate separation preventing protrusion 11 stops the plate from moving toward an opposite direction to the bottom surface of the male housing 10, that is, the open portion. The plate separation preventing protrusion 11 contacts a separation preventing part 33 of the plate, to be described below, to stop the plate from being separated upwardly.

The plate is arranged to cover the male terminal (not shown) and is configured to be inserted into the male housing 10. The plate is provided with the support part 31 which is locked and supported by the plate support member 15 and the upper portion of the support part 31 is provided with the separation preventing part 33 which is configured to be spaced apart from the support part 31 at a predetermined distance (see FIG. 6). The support part 31 and the separation preventing part 33 are integrally provided and are made of an elastic material.

The bottom surface of the plate is provided with a plurality of holes (not shown) through which the male terminal (not shown) of the bottom surface of the male housing 10 passes. To be locked to the plate support member 15 of the male housing 10 at the time of the insertion, a position corresponding to the plate support member 15 on the side wall of the plate is provided with the male hole. The support part 31 contacting the plate support member 15 of the male housing 10 based on the hole on the side wall of the plate and the separation preventing part 33 contacting the separation preventing protrusion 11 of the male housing 10 are integrally formed. In particular, the upper surface of the side wall of the plate becomes the separation preventing part 33 which contacts the separation preventing protrusion 11 of the male housing 10.

A returning protrusion 35 is integrally formed between the support part 31 of the plate and the separation preventing part 33. The returning protrusion 35 protrudes from the plate and contacts an outer side of the female housing 20. The returning protrusion 35 is locked to a plate tow protrusion 21 of the female housing 20 to be described below to allow the plate to be spaced apart from the male housing 10 by a predetermined distance as soon as the female housing 20 is separated from the inner side of the male housing 10.

Figure 4:
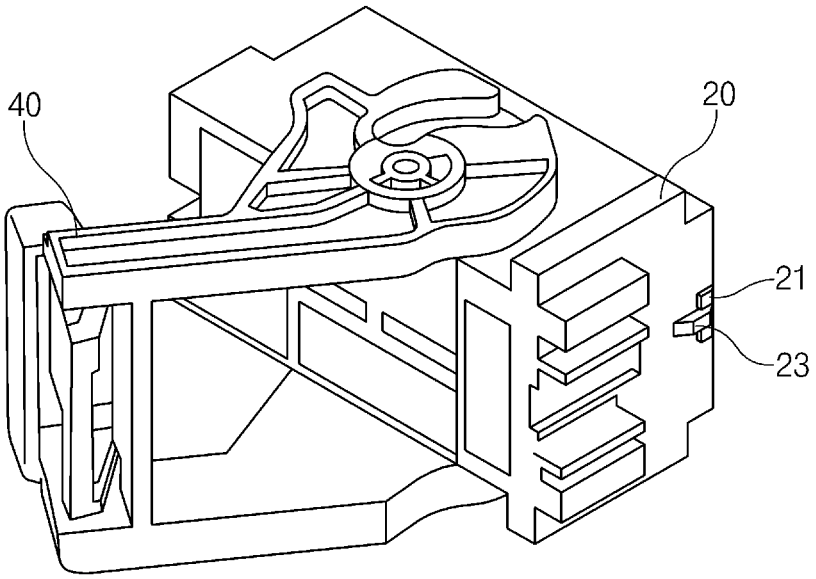
FIG. 4 is a perspective view of a female housing of the lever type connector according to the exemplary embodiment of the present invention.
Figure 5:
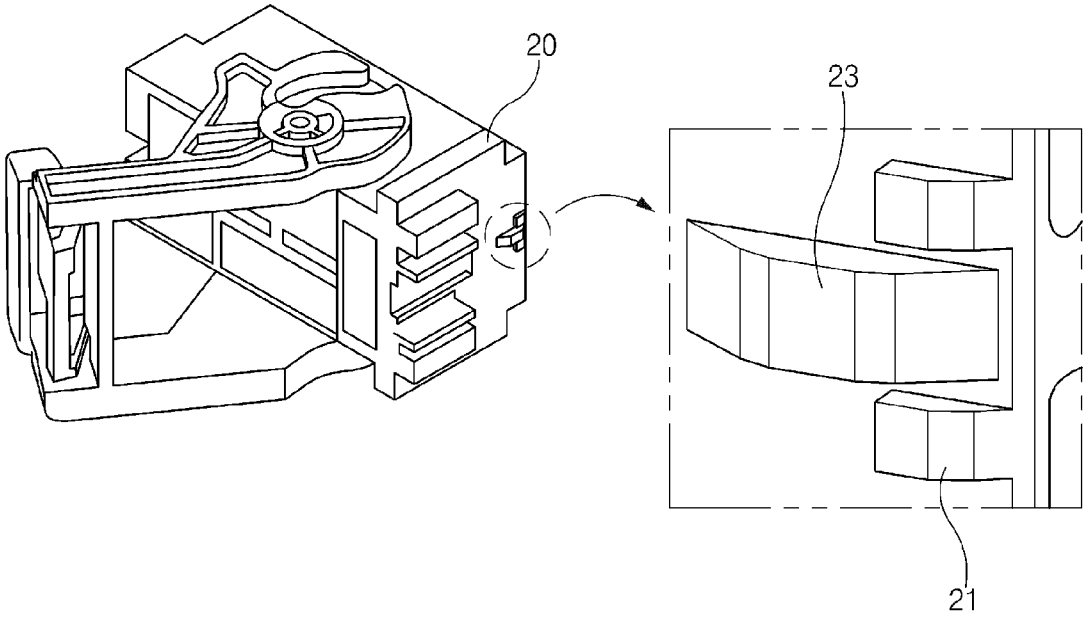
FIG. 5 is an enlarged view of a releasing protrusion and a plate tow protrusion of the female housing of FIG. 4.
Figure 6:
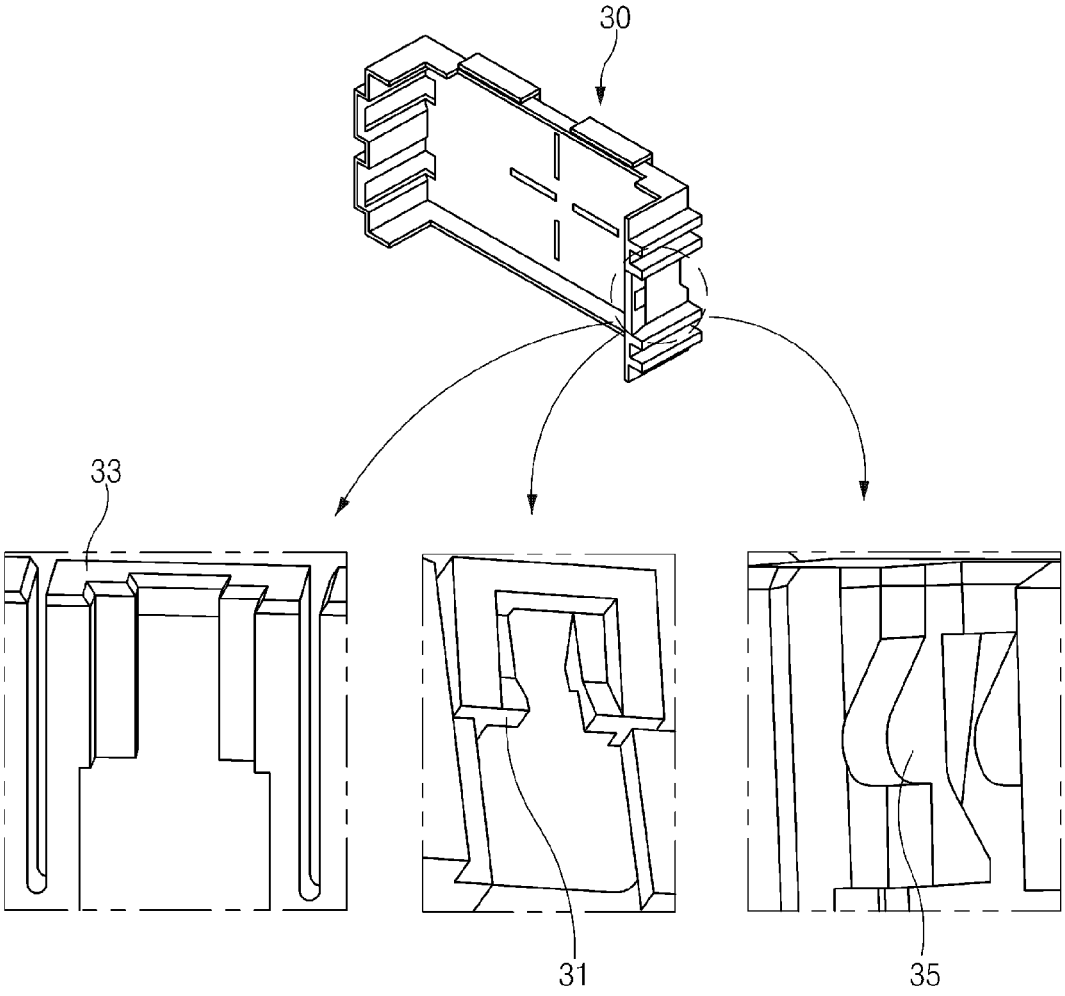
FIG. 6 is an enlarged view of a support part and a separation preventing part and a returning protrusion of the plate of FIG. 3.
Figure 7:
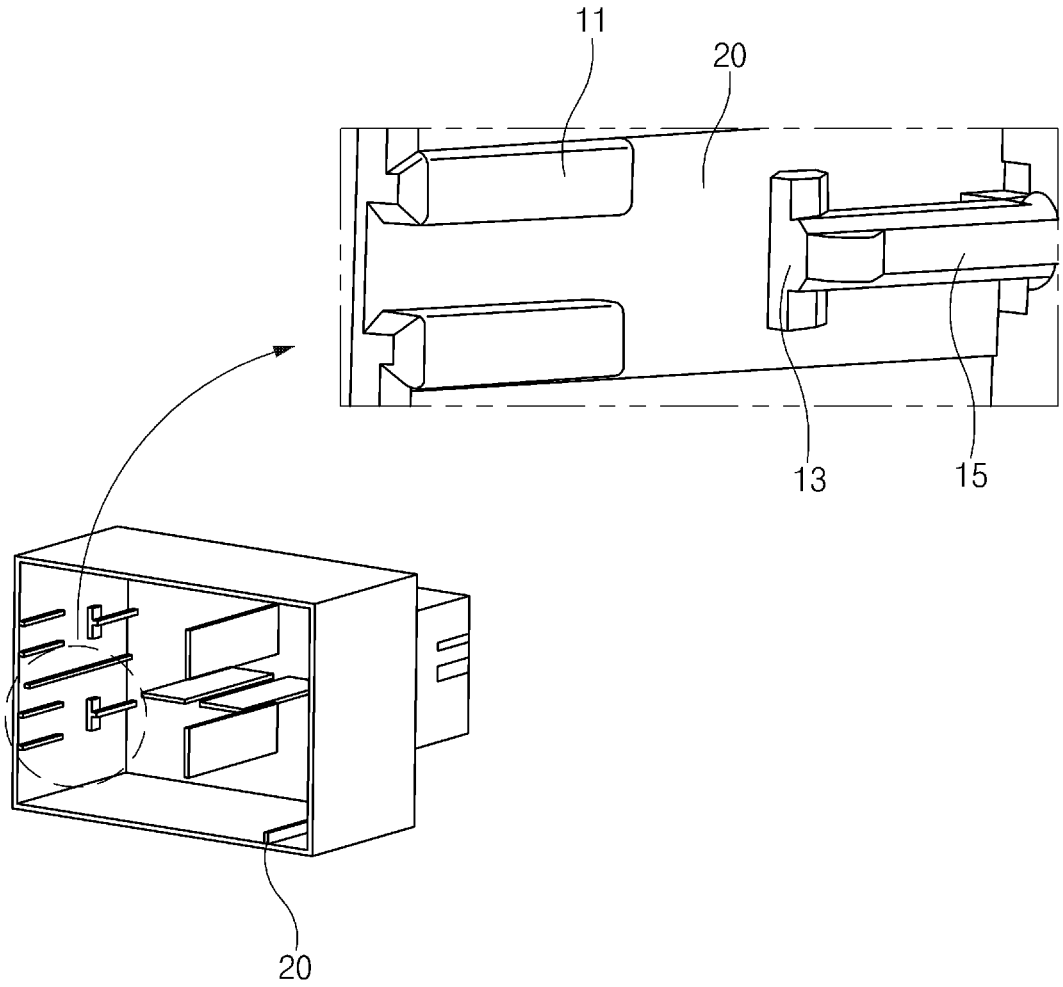
FIG. 7 is an enlarged view of a plate separation preventing protrusion and a plate support member of the male housing of FIG. 3.

As shown in FIGS. 4 and 5, the female housing 20 is provided to be inserted into the male housing 10 and the surface contacting the bottom surface of the male housing 10 is coupled with the male terminal (not shown), such that the female housing 20 is electrically connected to the male terminal. The female housing 20 is provided with a hinge to be rotatably coupled with the lever 40. The lever 40 is rotatably coupled with the female housing 20. The lever 40 serves as a handle which allows the female housing 20 to be inserted into the male housing 10 or separated from the male housing 10 and serves to fix the coupling of the male housing 10 with the female housing 20.

The outer side of the female housing 20 is provided with a releasing protrusion 23 and the plate tow protrusions 21 protruding at both sides of the releasing protrusion 23.

The releasing protrusion 23 protrudes from the outer side and when the female housing 20 is inserted into the male housing 10, presses the plate support member 15 of the inner side of the male housing 10. The releasing protrusion 23 is preferably provided in a shape corresponding to the plate support member 15 and the plate support member 15 of the elastic material is deformed toward the side wall of the male housing 10. Therefore, the locking to the support part 31 of the plate which is supported by the plate support member 15 is released, and thus the plate 30 may be inserted into the bottom surface of the male housing 10.

Unlike the releasing protrusion 23, the plate tow protrusion 21 is locked to the returning protrusion 35 of the plate 30 when the female housing 20 is separated from the male housing 10 to move the plate 30 in the separation direction along with the female housing 20. Therefore, when the female housing 20 is separated from the male housing 10, the plate 30 automatically returns to an original position to allow the plate 30 to protect the male terminal (not shown).

The use of the lever type connector according to the exemplary embodiment of the present invention provided as described above will be described with reference to the accompanying drawings.

Figure 8:
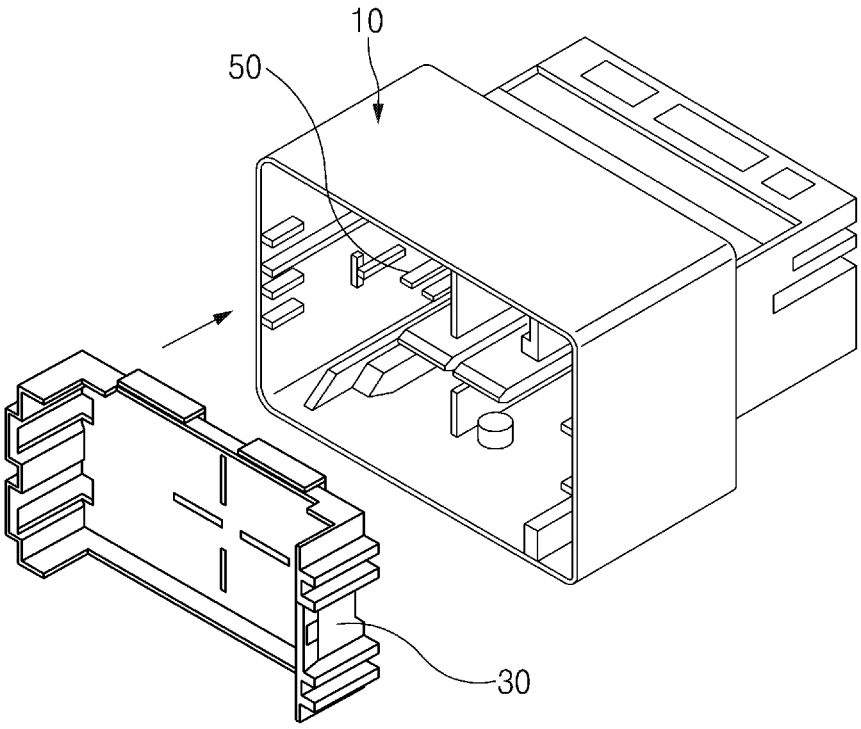
FIGS. 8 to 12 are diagrams illustrating an appearance in which the plate is inserted into the male housing.
Figure 9:
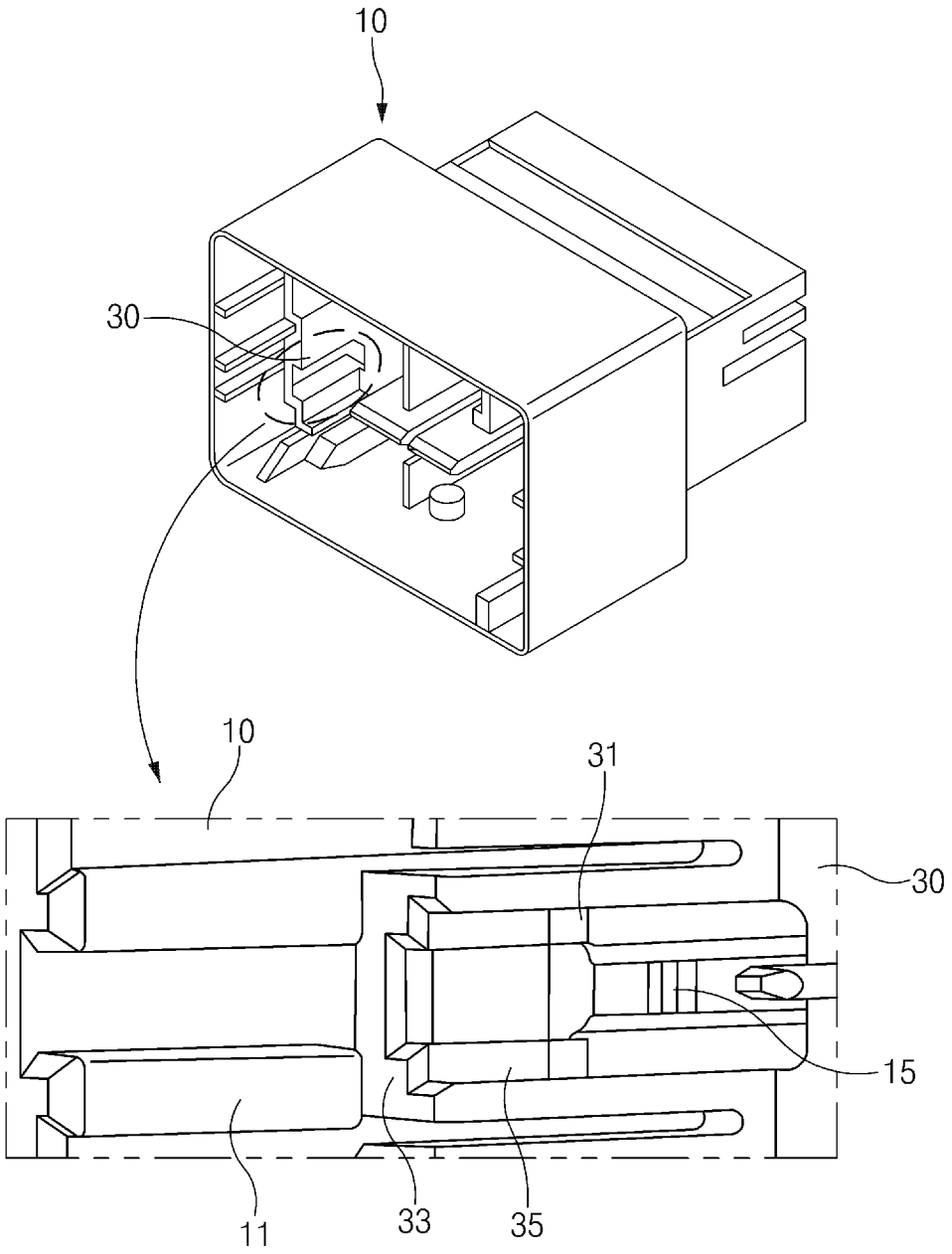

First, as shown in FIGS. 8 and 9, the plate 30 is inserted into the male housing 10 in which the one side is open. The plate 30 is supported by the plate support member 15 which is disposed on the side wall of the male housing 10, and thus the bottom surface of the plate 30 keeps not contacting the bottom surface of the male housing 10. Therefore, the plate 30 protects the male terminal (not shown) which is provided on the bottom surface of the male housing 10.

Figure 10:
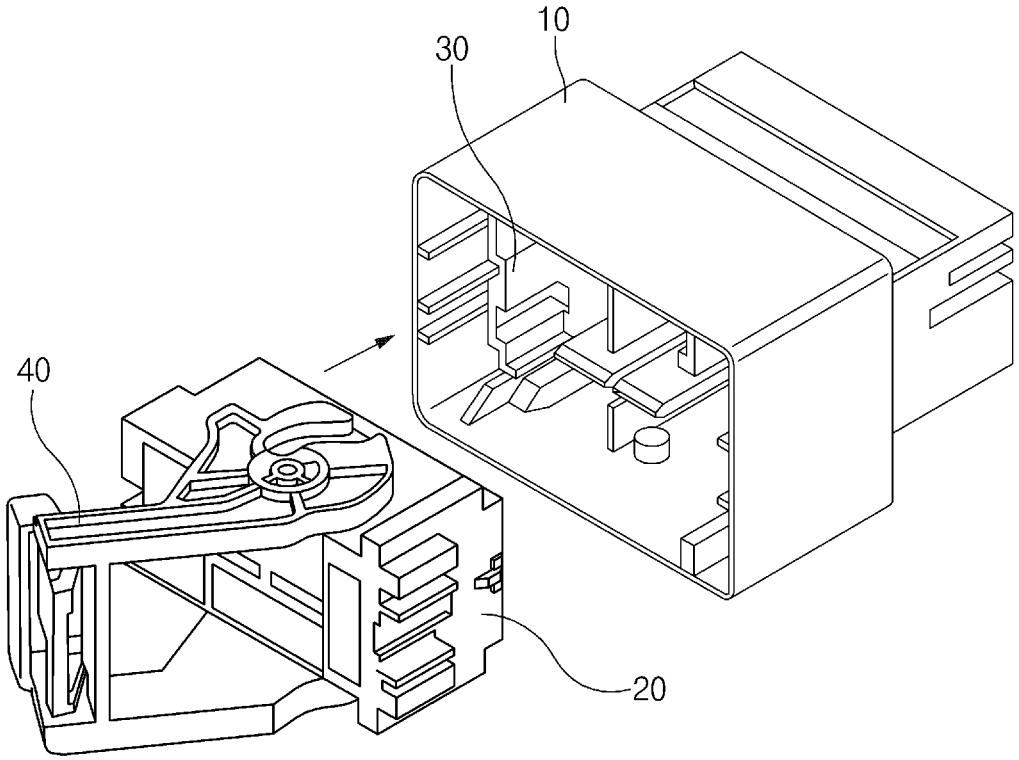
Figure 11:
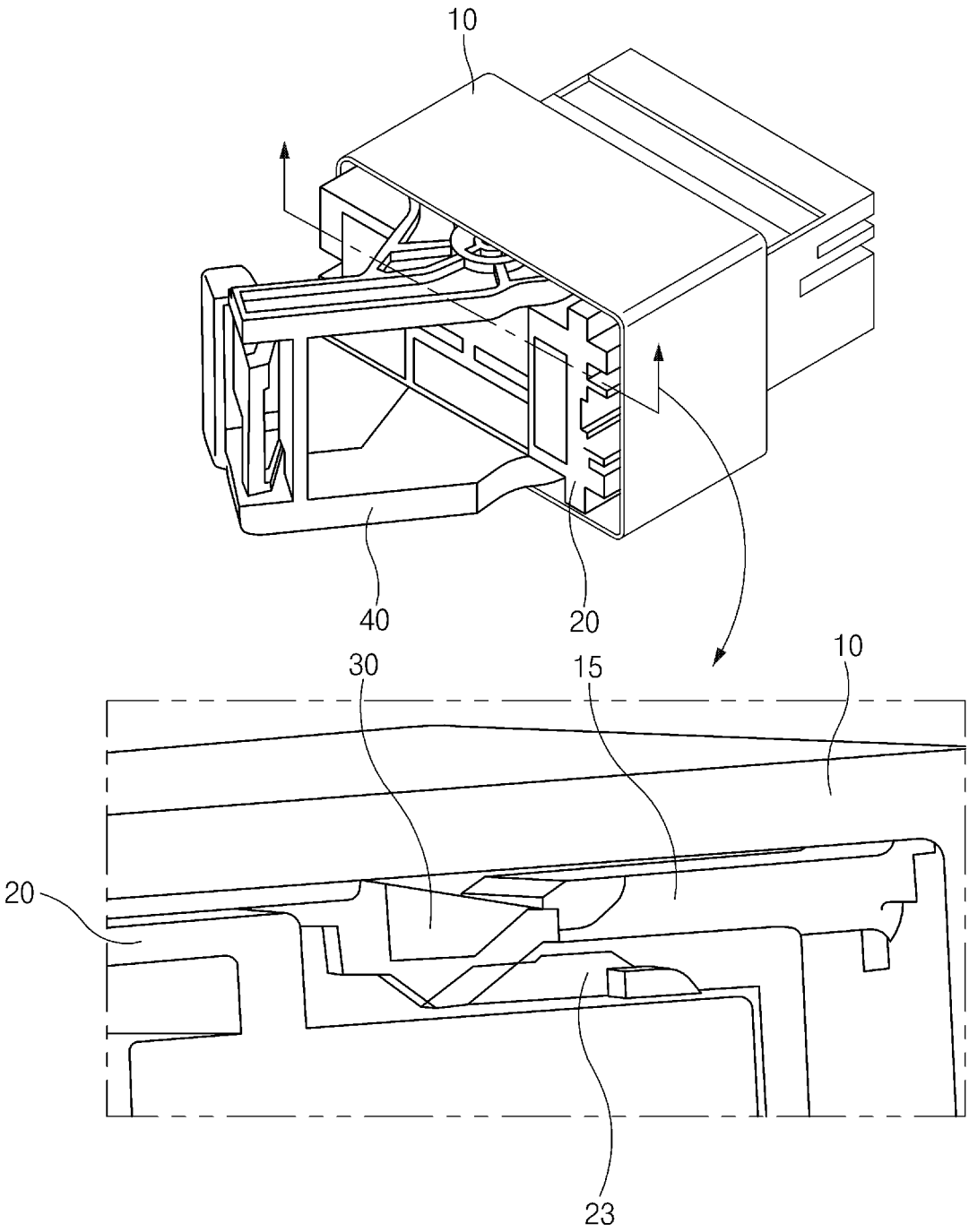
Figure 12:
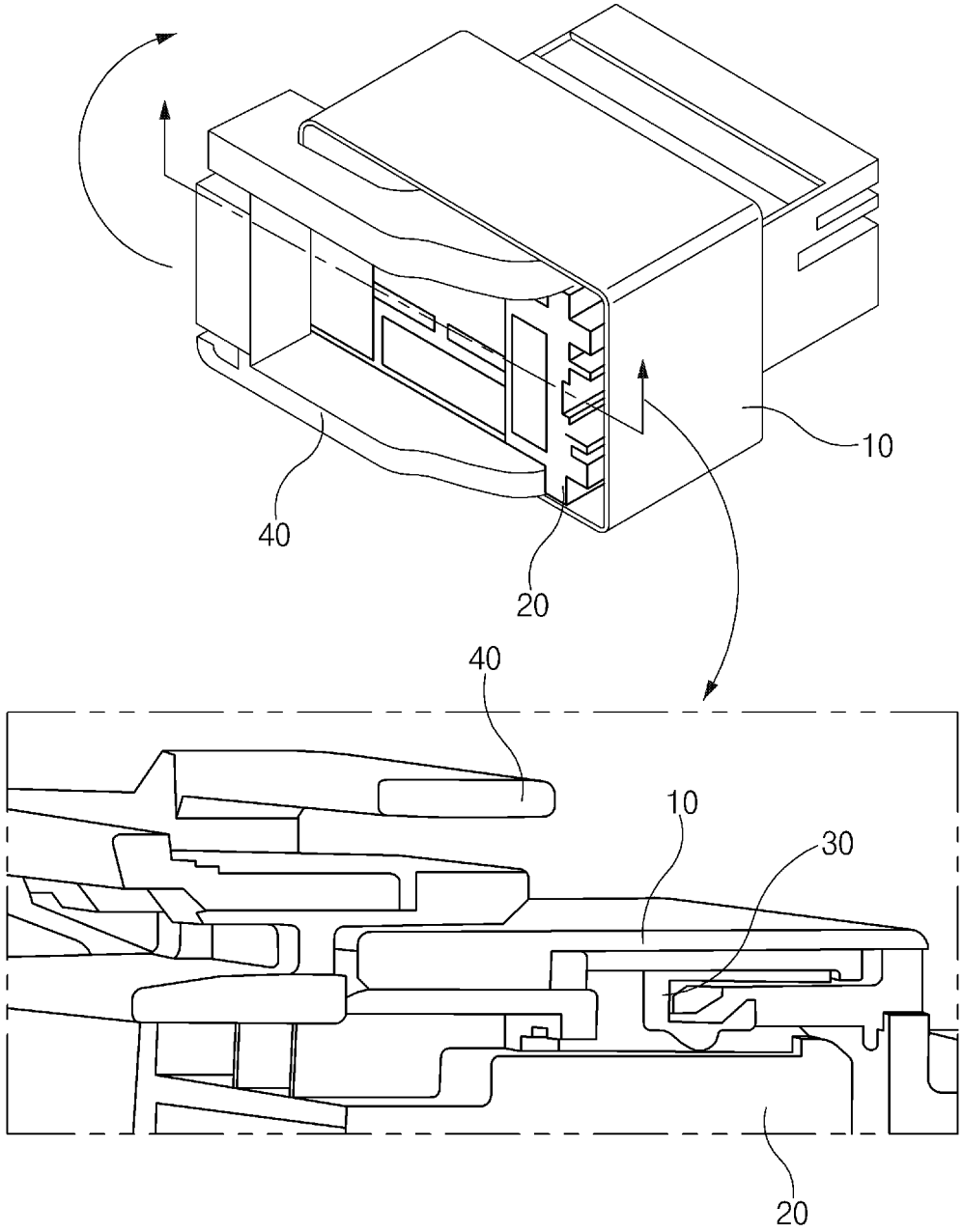

Next, as shown in FIG. 10, the female housing 20 is inserted into the male housing 10. The female housing 20 is inserted and the releasing protrusion 23 provided on the outer side of the female housing 20 presses the plate support member 15 which protrudes between holes of the plate 30. The plate support member 15 of the elastic material is deformed toward the male housing 10 by the releasing protrusion of the female housing 20 and thus the plate support member 15 is unlocked from the support part 31 of the plate 30 (see FIG. 11). As the plate support member 15 is unlocked the support part 31 of the plate 30, the plate 30 is also inserted toward the bottom surface of the male housing 10 as soon as the female housing 20 is inserted. Therefore, the male terminal (not shown) passes through the hole (not shown) through which the male terminal (not illustrated) formed on the bottom surface of the plate 30 passes and is electrically connected to the female housing 20. In this case, the lever 40 connected to the female housing 20 is fastened with the outer side of the male housing 10 and the coupling of the male housing 10 with the female housing 20 is fixed (see FIG. 12).

Figure 13:
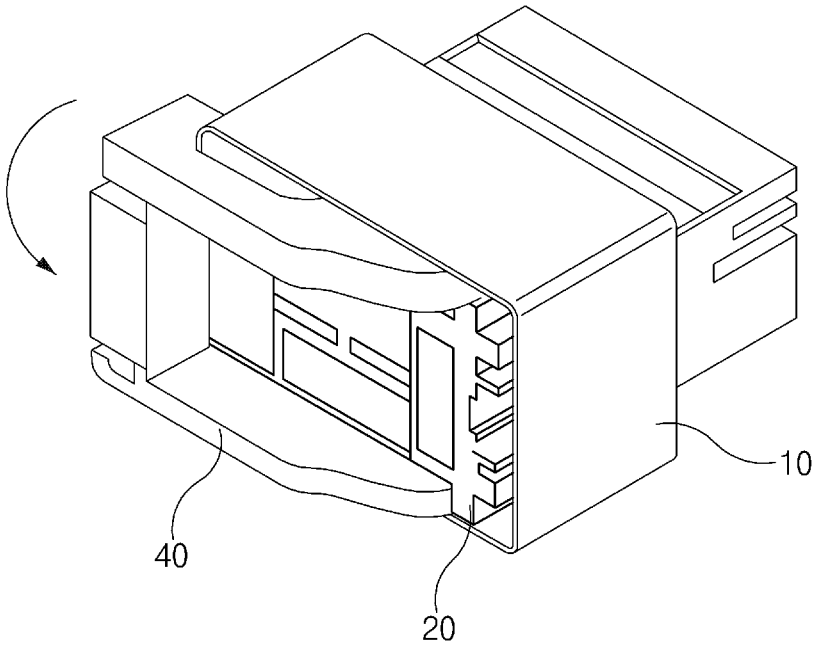
FIGS. 13 to 15 are diagrams illustrating an appearance in which the female housing is separated from the male housing.
Figure 14:
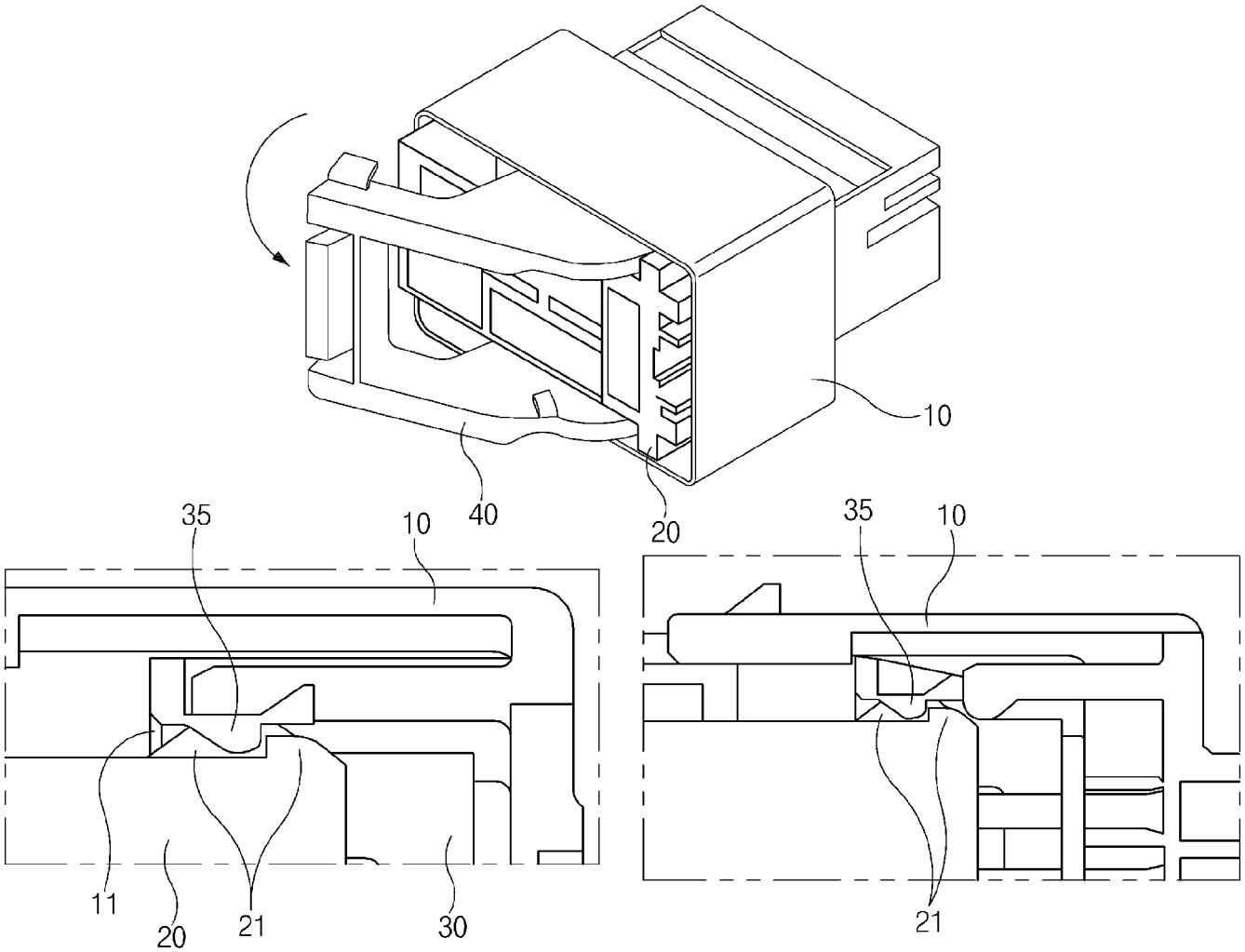
Figure 15:
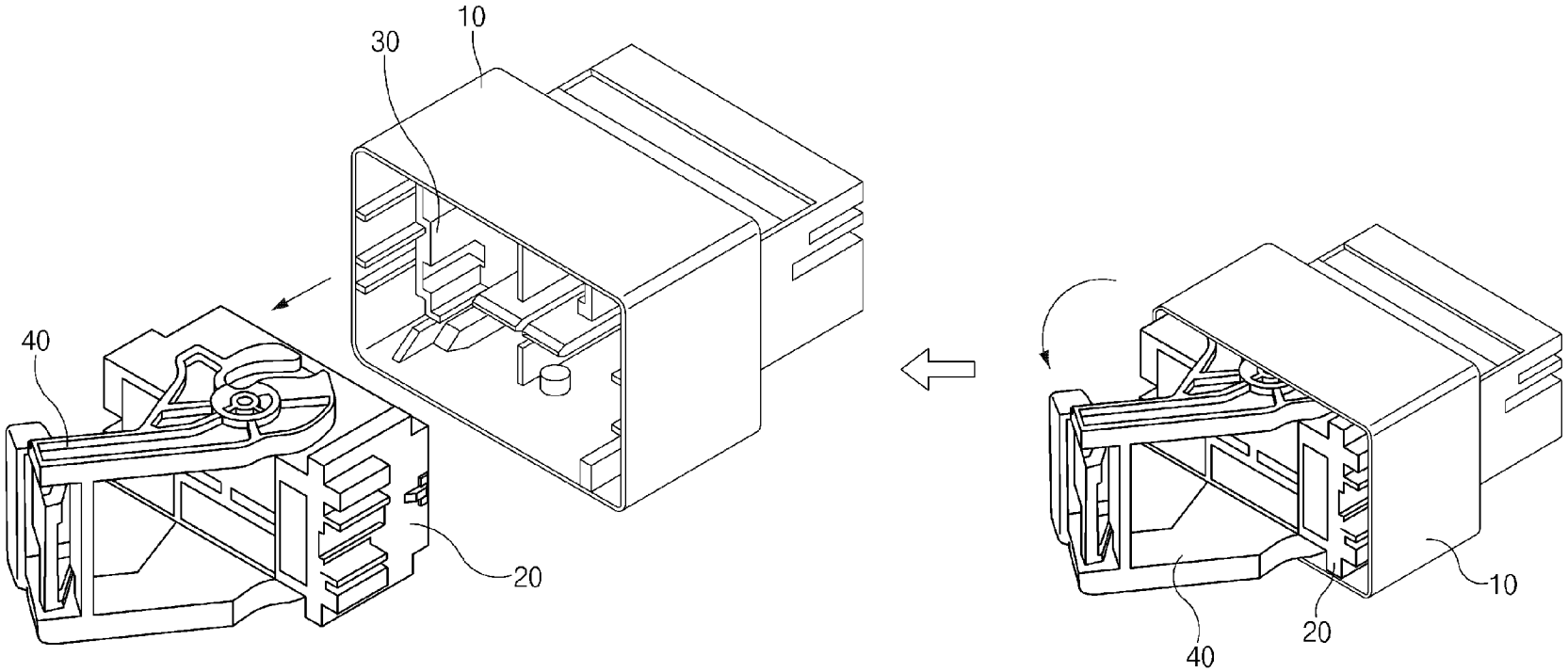

When the female housing 20 is separated from the male housing 10, the lever 40 connected to the female housing 20 rotates to move the female housing 20 to a position at which the female housing 20 is easily separated from the male housing 10 (see FIG. 13). As the female housing 20 moves to be separated from the male housing 10 by the lever 40, the plate tow protrusion 21 which is provided on the outer side of the female housing 20 is locked to the returning protrusion 35 of the plate (see FIG. 14). When the female housing 20 further moves by the lever 40, the plate returning protrusion 35 is locked to the plate tow protrusion 21 of the female housing 20 and thus the plate 30 moves together. Next, when the female housing 20 further moves, the plate separation preventing protrusion 11 which protrudes on the side wall of the male housing 10 contacts the separation preventing part 33 of the plate 30 and thus the plate separation preventing protrusion 11 stops the movement of the plate 30. As a result, the plate 30 is no further separated and the returning protrusion of the plate 30 of the elastic material is deformed, and as a result, the locking to the plate tow protrusion 21 is released. Therefore, only the female housing 20 is completely separated from the male housing 10, such that the plate support member 15 of the male housing 10 which is pressed and deformed by the outer side of the female housing 20 returns to an original position. Therefore, the plate 30 is again supported by the plate support member 15, and thus the plate 30 keeps not keep contacting the bottom surface of the male housing 10 to protect the male terminal (not shown) of the bottom surface (see FIG. 15).

As described above, according to the exemplary embodiments of the present invention, it is possible to provide the lever type connector provided with the plate capable of protecting the male terminal of the male housing and allowing the female housing return to an original position as soon as the female housing is separated from the male housing.

It is to be understood that the above-mentioned exemplary embodiments are illustrative rather than being restrictive in all aspects, and the scope of the present invention will be defined by the claims rather than the above-mentioned detained description. In addition, all modifications and alternations derived from the claims and their equivalents are to be interpreted to be included in the scope of the present invention.

What is claimed is:

1. A lever type connector, comprising:

a male housing having a box shape in which one side is open and a bottom surface for receiving at least a male terminal;

a plate configured to be inserted into the male housing for covering the male terminal;

a female housing configured to be inserted into the male housing; and a lever configured to be rotatably coupled with the female housing, wherein the male housing further has:

a plate support member being protruded from an inner side wall of the male housing and having an upper support surface formed on the upper portion of the plate support member to be spaced apart from the bottom surface of the male housing at a predetermined distance and to support the plate; and a plate separation preventing protrusion configured to protrude from an upper portion of the male housing, the plate separation preventing protrusion being spaced apart from the plate support member at a predetermined distance to support the plate so that the plate inserted into the male housing is not separated from an inside of male housing, and wherein the plate has: a support part which is locked and supported by the plate support member, a separation preventing part which is supported by the plate separation preventing protrusion; and a returning protrusion configured to protrude between the support part of the plate and the separation preventing part, and wherein the female housing has:

plate tow protrusions configured to protrude from an outer side of the female housing and be locked to the returning protrusion when the female housing is separated from the inner side of the male housing to move the plate along with the female housing, and wherein the plate support member of the male housing is unlocked from the support part of the plate when the female housing is inserted into the male housing and the plate moves to the bottom surface of the male housing along with the female housing, and the plate moves along with the female housing when the female housing is separated from an inner side of the male housing and the separation preventing part of the plate is supported by the plate separation preventing protrusion of the male housing to prevent the plate from being completely separated.

2. The lever type connector according to claim 1, wherein the plate support member is made of an elastic material.

3. The lever type connector according to claim 1, further comprising:

a releasing protrusion configured to protrude from an outer side of the female housing and press the plate support member when the female housing is inserted into the male housing to release the locking of the plate support member and the support part.

4. The lever type connector according to claim 1, wherein the plate support member is spaced apart from the inner side wall of the male housing at a predetermined distance, and the plate support member is deformed toward the inner side wall of the male housing when the female housing is inserted into the male housing and is unlocked from the support part of the plate.

5. The lever type connector according to claim 1, wherein the plate tow protrusions are formed at both sides of the releasing protrusion, and having a releasing protrusion disposed therebetween.

6. The lever type connector according to claim 1, wherein the returning protrusion is made of an elastic material.

7. A lever type connector, comprising:

a male housing having a box shape in which one side is open and a bottom surface for receiving at least a male terminal;

a plate configured to be inserted into the male housing for covering the male terminal;

a female housing configured to be inserted into the male housing;

a lever configured to be rotatably coupled with the female housing; and wherein the male housing further has:

a plate support member having an upper support surface formed on the upper portion of the plate support member to be spaced apart from the bottom surface of the male housing at a predetermined distance and to support the plate; and a plate separation preventing protrusion configured to protrude from an upper portion of the male housing, the plate separation preventing protrusion being spaced apart from the plate support member at a predetermined distance to support the plate so that the plate inserted into the male housing is not separated from an inside of male housing, wherein the plate has:

a support part which is locked and supported by the plate support member;

a separation preventing part which is supported by the plate separation preventing protrusion; and a returning protrusion configured to protrude between the support part of the plate and the separation preventing part, and wherein the female housing has:

plate tow protrusions configured to protrude from an outer side of the female housing and be locked to the returning protrusion when the female housing is separated from the inner side of the male housing to move the plate along with the female housing, and wherein the plate support member of the male housing is unlocked from the support part of the plate when the female housing is inserted into the male housing, the plate moves along with the female housing when the female housing is separated from an inner side of the male housing and the separation preventing part of the plate is supported by the plate separation preventing protrusion of the male housing to prevent the plate from being completely separated.

8. The lever type connector according to claim 7, wherein the plate support member is made of an elastic material.

9. The lever type connector according to claim 7, further comprising:

a releasing protrusion configured to protrude from an outer side of the female housing and press the plate support member when the female housing is inserted into the male housing to release the locking of the plate support member and the support part.

10. The lever type connector according to claim 7, wherein the plate support member is spaced apart from the inner side wall of the male housing at a predetermined distance, and the plate support member is deformed toward the inner side wall of the male housing when the female housing is inserted into the male housing and is unlocked from the support part of the plate.

11. The lever type connector according to claim 7, wherein the plate tow protrusions are formed at both sides of the releasing protrusion, and having a releasing protrusion disposed therebetween.

12. The lever type connector according to claim 7, wherein the returning protrusion is made of an elastic material.

* * * * *